US012422170B2

(12) United States Patent
Lee et al.

(10) Patent No.: US 12,422,170 B2
(45) Date of Patent: Sep. 23, 2025

(54) HEAT PUMP

(71) Applicant: LG ELECTRONICS INC., Seoul (KR)

(72) Inventors: Youngmin Lee, Seoul (KR); Jihyeong Ryu, Seoul (KR); Eunjun Cho, Seoul (KR); Minsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 230 days.

(21) Appl. No.: 17/802,055

(22) PCT Filed: Feb. 24, 2021

(86) PCT No.: PCT/KR2021/002317
§ 371 (c)(1),
(2) Date: Aug. 24, 2022

(87) PCT Pub. No.: WO2021/172868
PCT Pub. Date: Sep. 2, 2021

(65) Prior Publication Data

US 2023/0101537 A1 Mar. 30, 2023

(30) Foreign Application Priority Data

Feb. 25, 2020 (KR) ..... 10-2020-0023201

(51) Int. Cl.
*F25B 13/00* (2006.01)
*F25B 41/26* (2021.01)
*F25B 41/31* (2021.01)

(52) U.S. Cl.
CPC ..... *F25B 13/00* (2013.01); *F25B 41/26* (2021.01); *F25B 41/31* (2021.01); *F25B 2500/09* (2013.01)

(58) Field of Classification Search
CPC ..... F25B 47/022; F25B 47/006; F25B 2600/2501; F25B 2313/003; F25D 21/12
See application file for complete search history.

(56) References Cited

U.S. PATENT DOCUMENTS 5,099,651 A 3/1992 Fischer
2010/0064699 A1 3/2010 LLurens
(Continued)

FOREIGN PATENT DOCUMENTS

CN 202470558 10/2012
CN 202734367 2/2013
(Continued)

OTHER PUBLICATIONS

International Search Report dated Jun. 23, 2021 issued in Application No. PCT/KR2021/002317.
(Continued)

*Primary Examiner* — Ana M Vazquez
(74) *Attorney, Agent, or Firm* — KED & ASSOCIATES

(57) ABSTRACT

A heat pump is provided that includes a first pipe in which a first refrigerant flows; a second pipe disposed at a side of the first pipe and in which a second refrigerant flows; a first heat exchanger connected with the first pipe and the second pipe and in which the first refrigerant exchanges heat with the second refrigerant; a boiler connected with the first pipe and in which the first refrigerant flows; a compressor connected with the second pipe and that compresses the second refrigerant; a second heat exchanger connected with the second pipe and in which the second refrigerant exchanges heat with outdoor air; a bypass pipe branched from first pipe and configured to exchange heat with the second heat exchanger; and a three-way valve that directs the first refrigerant to pass through the bypass pipe. When the
(Continued)

outdoor heat exchanger operates as an evaporator, frost formation thereon may be prevented.

8 Claims, 3 Drawing Sheets

(56) References Cited

U.S. PATENT DOCUMENTS

| | | | | |
|---|---|---|---|---|
| 2010/0077788 | A1 | 4/2010 | Lewis | |
| 2011/0214444 | A1 | 9/2011 | Yoshii | |
| 2013/0291571 | A1* | 11/2013 | Amick | F25D 21/06 62/81 |
| 2020/0003480 | A1* | 1/2020 | Bostic, Jr. | F25D 21/12 |

FOREIGN PATENT DOCUMENTS

| | | | |
|---|---|---|---|
| CN | 204006655 | | 12/2014 |
| CN | 205878705 | | 1/2017 |
| CN | 209819922 | | 12/2019 |
| EP | 2 048 451 | | 4/2009 |
| EP | 2 933 588 | | 10/2015 |
| EP | 2 940 408 | | 11/2015 |
| EP | 3 165 852 | | 5/2017 |
| JP | H6-18141 | | 1/1994 |
| JP | 09-280698 | | 10/1997 |
| JP | 2007-155296 | | 6/2007 |
| JP | 2008-32346 | | 2/2008 |
| JP | 2008-82664 | | 4/2008 |
| KR | 10-2004-0090129 | | 10/2004 |
| KR | 10-0643689 | | 11/2006 |
| KR | 100643689 | B1 * | 11/2006 |
| KR | 10-2011-0105180 | | 9/2011 |
| KR | 101126675 | B1 * | 4/2012 |
| KR | 10-1255760 | | 4/2013 |
| KR | 10-1455973 | | 11/2014 |
| KR | 10-2019-0023010 | | 3/2019 |

OTHER PUBLICATIONS

Chinese Office Action dated Jun. 16, 2023 issued in Application No. 202180016960.5.

European Search Report issued in Application No. 21760004.8 dated May 22, 2024.

Chinese Office Action issued in Application No. 202180016960.5 dated Jan. 24, 2024.

European Search Report issued in Application No. 21760004.8 dated Feb. 5, 2024.

Japanese Office Action dated Oct. 15, 2024, in Application No. 2022-550958.

Korean Office Action issued in Application No. 10-2020-0023201 dated Mar. 7, 2025.

* cited by examiner

HEAT PUMP

CROSS-REFERENCE TO RELATED PATENT APPLICATIONS

This application is a U.S. National Stage Application under 35 U.S.C. § 371 of PCT Application No. PCT/KR2021/002317, filed Feb. 24, 2021, which claims priority to Korean Patent Application No. 10-2020-0023201, filed Feb. 25, 2020, whose entire disclosures are hereby incorporated by reference.

TECHNICAL FIELD

The present disclosure relates to the heat pump and, more specifically, to heat pump that increases heating efficiency and saves energy in heating mode.

BACKGROUND ART

In the case of the heat pump according to the prior art, the refrigerant of the cooling operation mode is discharged from the compressor and then transferred to the outdoor heat exchanger via the four-way valve and transferred from the outdoor heat exchanger to the indoor heat exchanger through an expansion mechanism and sucked into the compressor through the accumulator.

In the heating operation mode, the refrigerant flowing into the outdoor heat exchanger is in a liquid state.

The heat required for the liquid refrigerant to evaporate into a gaseous state is obtained from outdoor air.

Therefore, when the outside temperature is low, the evaporation of the refrigerant decreases, and accordingly, the liquid component of the refrigerant flowing into the indoor heat exchanger increases, and the heating performance is greatly reduced.

When the outside air temperature is lowered to 0° C. or less, which is the freezing point of water, frost is deposited on the outdoor heat exchanger and the heating operation efficiency is greatly reduced.

To solve the above problem, the recent heat pump is designed to have a defrost mode in which the heat pump is operated in reverse from the heating mode to the cooling mode for a certain time. When it is switched to the defrost mode in this way, the frost attached to the outdoor heat exchanger can be removed.

However, in conventional heat pump, when the indoor heat exchanger is in the heating mode, heating is performed by simply circulating the refrigerant in the heat pump cycle, so that it significantly falls short of consumer's expectation for an increase in heating efficiency and saving energy.

In addition, there is also a problem that the evaporation temperature drops excessively during heating and then generates freeze.

Accordingly, there is a need for a structure capable of preventing or delaying frost occurring in the outdoor heat exchanger of the air conditioner exposed to a low temperature environment.

DISCLOSURE OF INVENTION

Technical Problem

The problem to be solved by the present disclosure is to efficiently prevent frosting that may occur in an outdoor heat exchanger during a heating operation or to efficiently reduce the frosting generated.

The problems of the present disclosure are not limited to the problems mentioned above, and other problems that are not mentioned will be clearly understood by those who skilled in the art from the following description.

Solution to Problem

To achieve the above problem, the heat pump according to the embodiment of the present disclosure includes a first pipe in which a first refrigerant flow, a second pipe disposed at the side of the first pipe and in which a second refrigerant flow, a first heat exchanger connected with the first pipe and the second pipe and in which the first refrigerant exchange heat with the second refrigerant, a boiler connected with the first pipe and in which the first refrigerant flow, a compressor connected with the second pipe and compressing the second refrigerant, a second heat exchanger connected with the second pipe and in which the second refrigerant exchange heat with an outdoor air, a bypass pipe branched from first pipe and disposed to exchange heat with the second heat exchanger and a three-way valve for inducing the first refrigerant to pass through the bypass pipe.

Details of other embodiments are included in the detailed description and drawings.

Advantageous Effects of Invention

According to this embodiment, by installing a water pipe in a position close to the second heat exchanger 120, 220 used as an evaporator during heating or by installing a refrigerant pipe immediately after emission from the condenser, and by circulating the high temperature fluid toward the evaporator, the freezing on surface of the second heat exchanger 120, 220 may be delayed.

In addition, by applying it to the boiler B communicated with the heat pump, the inflow temperature into the plate heat exchanger, which is a condenser, may be lowered and then leads to an increase in efficiency.

In addition, by lowering the inflow temperature, the operating range of the heat pump is widened so that operating cost may be reduced.

MODE FOR THE INVENTION

Advantages and features of the present disclosure, and a method of achieving them will become apparent with reference to the embodiments described below in detail together with the accompanying drawings. However, the present disclosure is not limited to the embodiments disclosed below but may be implemented in a variety of different forms. The present embodiments are provided to disclose completely the present disclosure and to fully inform the scope of the present disclosure to those who skilled in the art to which the present disclosure pertains. The disclosure is only defined by the scope of the claims. The same reference sign refers to the same elements throughout the whole specification.

Figure 1:
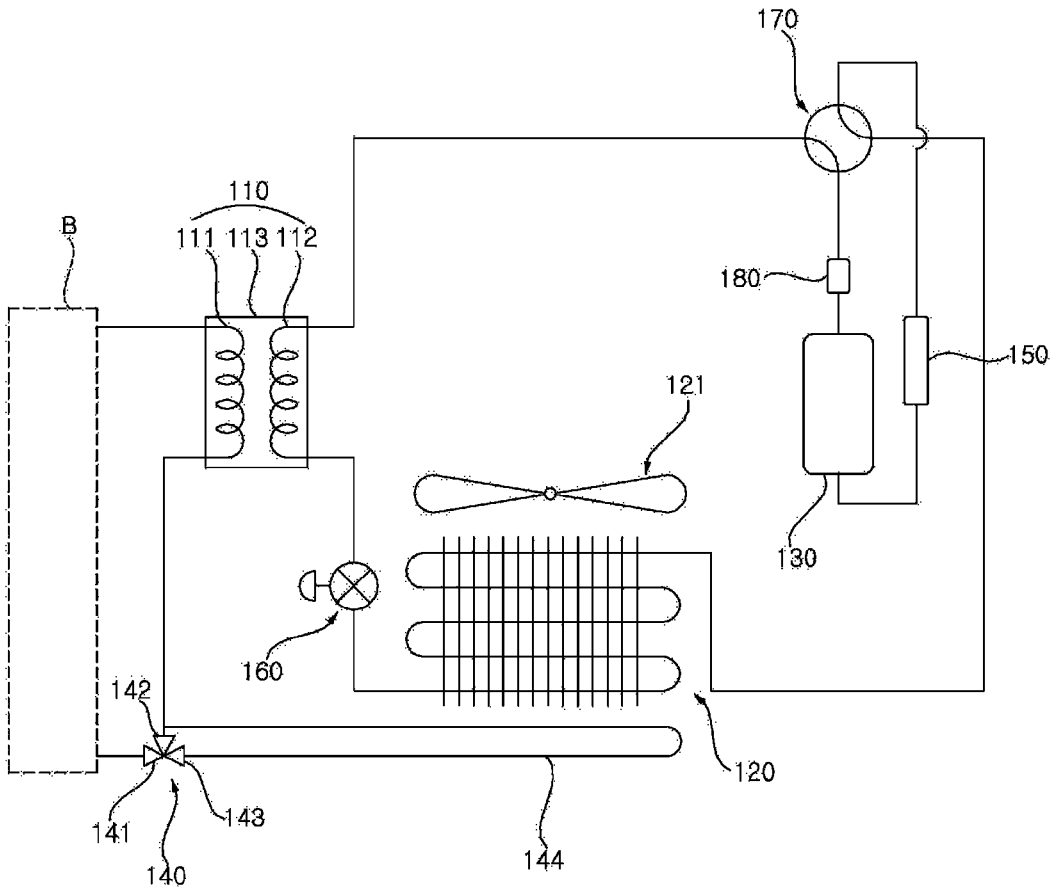
FIG. 1 schematically shows the heat pump according to one embodiment of the present disclosure.

FIG. 1 schematically shows the heat pump according to one embodiment of the present disclosure.

Referring to FIG. 1, the heat pump may include a first heat exchanger 110 including a first pipe 111 in which a first refrigerant flow, and a second pipe 112 disposed to the side of the first pipe 111 and in which a second refrigerant flow, a boiler B connected with the first pipe 111, a compressor 130 and a second heat exchanger 120 which are connected with the second pipe 112 in which the second refrigerant flow, a bypass pipe 144 disposed to exchange heat between the second heat exchanger 120 and the first refrigerant and a three-way valve 140 switched to induce the first refrigerant to pass through the bypass pipe 144.

The first heat exchanger 110 may operate variably depending on the flow direction of the first refrigerant or the second refrigerant, which is changed by the cooling mode or heating mode of the heat pump.

Specifically, the first heat exchanger 110 may operate as the condenser condensing high-temperature, high-pressure, and gaseous refrigerant into room temperature, high-pressure, and liquid state during the heating operation of the heat pump. The first heat exchanger 110 may operate as the evaporator that evaporates low-temperature, low-pressure, liquid refrigerant into a gaseous state during cooling operation of the heat pump.

As described above, by operating the first heat exchanger in reverse to the second heat exchanger 120 depending on the circulation of the first refrigerant or the second refrigerant, air conditioning desired by the user may be achieved.

In addition, the first heat exchanger 110 may be a plate heat exchanger having refrigerants flowing independently.

The first heat exchanger 110 has the first pipe 111 and the second pipe 112 disposed at both ends so that the first refrigerant and the second refrigerant may not contact each other and may flow independently.

The flow inside the first heat exchanger 110 will be described in more detail. The first refrigerant has a single path, where the first refrigerant flow into the first pipe 111 through an inlet (not shown) formed on the left end and flow to a longitudinal direction of a plate 113 by moving to one side and emitted through the other side of the first pipe 111.

In addition, the second refrigerant flowing into the second pipe 112 through an inlet (not shown) formed on the right end has a single path, where the second refrigerant flow to the longitudinal direction (opposite to the flowing direction of the first refrigerant) of the plate 113 by moving to the one side and is emitted through an outlet (not shown) of the second pipe 112.

In addition, plate 113 may define a first flow part and a second flow part mentioned above by the bonding of a bonding part (not shown) that bonds two kinds of a first plate (not shown) and a second plate (not shown). Here, the plates 113 adjacent to each other may be bonded to each other by brazing.

A blowing fan 121 may be provided on one side of the second heat exchanger 120. The blowing fan 121 may guide the outdoor air to the second heat exchanger 120.

The air forced to flow by the blowing fan 121 exchanges heat with the second refrigerant flowing inside the second heat exchanger 120.

A boiler B is connected to the first pipe 111 and may perform the hot water supply function with a water refrigerant flowing inside the first pipe 111.

The second refrigerant may include the refrigerant R32 or R290 circulating the second heat exchanger 120 and a compressor 130.

In other words, the second refrigerant may include one or a mixed refrigerant in the group selected as difluoromethane (R32) or propane (Propane, R290), which are alternative refrigerant having the OZONE DEPLETION POTENTIAL (ODP) of 0.0.

The compressor 130 compresses the gas refrigerant having low temperature and low pressure to high temperature and high pressure and supplies it to the condenser.

In addition, the compressor 130 may be provided in plural. For example, when the compressor 130 is an inverter compressor capable of converting an operating frequency, it may include a constant speed compressor using a fixed operating frequency.

The bypass pipe 144 may be branched from the first pipe 111. The first refrigerant flow inside the bypass pipe 144.

A three-way valve 140 may include a first flow path 141, a second flow path 142 and a third flow path 143. The first flow path 141 may circulate the first refrigerant by being connected with the boiler B. The second flow path 142 may be connected to the first pipe 111. The third flow path 143 may be disposed to join to the second flow path 142 via the bypass pipe 144 exchanging heat with the second heat exchanger 120 and emitted in the direction excluding the first flow path 141 and the second flow path 142.

In the cooling mode of the heat pump, the three-way valve 140 may be controlled to close so that the first refrigerant passing through the boiler B is not supplied to the second heat exchanger 120. In the heating mode, the three-way valve 140 may be controlled to open so that the first refrigerant passing through the boiler B is supplied to the second heat exchanger 120. The operation related to this will be described later.

An accumulator 150 may be further included between the compressor 130 and the second heat exchanger 120.

In the accumulator 150, the liquid refrigerant that has not been evaporated is filtered out, and only the gaseous refrigerant is selected and then supplied to the compressor 130.

The accumulator 150 may be provided between pipes on the suction side of the compressor 130. The accumulator 150 receives the refrigerant from the first heat exchanger 110 or the second heat exchanger 120 and separates the refrigerant into a gaseous and liquid state and then supplies only a gaseous refrigerant to the compressor 130.

An expansion valve 160 may be further included between the second pipe 112 and the second heat exchanger 120.

The expansion valve 160 expands the liquid refrigerant of room temperature and high pressure that has passed through the condenser and supplies the liquid refrigerant of low temperature and low pressure to the evaporator.

As the expansion valve 160, an electric expansion valve capable of controlling an opening degree may be applied.

When the heat pump operates in the heating mode, a four-way valve 170 guides the refrigerant passing through the compressor 130 to flow into the first heat exchanger 110 and guides the refrigerant passing through the second heat exchanger 120 to flow into the accumulator 150.

Meanwhile, when the heat pump operates in the cooling mode, the four-way valve 170 guides the refrigerant passing through the compressor 130 to flow into the second heat exchanger 120 and controls the refrigerant passing through the first heat exchanger 110 to flow into the accumulator 150.

A muffler 180 may be further included between the four-way valve 170 and the compressor 130. The expansion valve 160 is generally used with a capillary tube, which does not affect the refrigeration performance, but generates noise due to a rapid change in the flow of the refrigerant.

The noise at this time includes a loud flow noise due to a complex change in phase, pressure, speed and internal energy of the refrigerant, and the muffler 180 may be included to reduce such noise.

In other words, the muffler 180 performs reducing the vibration or noise of the refrigerant emitted from the compressor 130.

Hereinafter, the operation of the heat pump according to one embodiment of the present disclosure will be described.

When the heat pump according to an embodiment of the present disclosure operates in the heating mode, the high-temperature, high-pressure refrigerant emitted from the compressor 130 by the control of the four-way valve 170 flow to the first heat exchanger 110.

Thereafter, the second refrigerant in a high-temperature and high-pressure state is condensed and liquefied during exchanging heat with the first refrigerant passing through the first heat exchanger 110.

Thereafter the second refrigerant passing through the expansion valve 160 passes through the second heat exchanger 120 in the state of a two-phase refrigerant with a high temperature and low pressure.

As a result, the second heat exchanger 120 operates as an evaporator, and the surface temperature of the second heat exchanger 120 becomes a low temperature state.

Here, since the surface temperature of the second heat exchanger 120 become lower than the external temperature, condensate is formed on the surface of the second heat exchanger 120.

In addition, when the external temperature is lower than or equal to the freezing temperature, the condensate is frozen on the surface of the second heat exchanger 120. As this state lasts for a long time, the heat exchange performance of the second heat exchanger 120 with the external air declines due to the freezing of the condensate, and finally, ice frozen on the surface must be removed by performing a defrost operation.

For this, the first refrigerant with a relatively high temperature emitted from the boiler B is bypassed to the bypass pipe 144 by the control of the three-way valve 140.

Accordingly, the ice generated on the outer surface of the second heat exchanger 120 may be melted and removed through the process of heat-exchanging of the second refrigerant with the second heat exchanger 120.

The bypass pipe 144 may be disposed as close as possible to exchange heat with the second heat exchanger 120, and its position may be variously applied depending on the design position.

Meanwhile, when the heat pump according to one embodiment of the present disclosure operates in the cooling mode, the refrigerant emitted from the compressor 130 flow to the second heat exchanger 120 in a state of high temperature and high pressure under the control of the four-way valve 170.

Thereafter, the second refrigerant in a high-temperature and high-pressure state passing through the second heat exchanger 120 is condensed and liquefied during heat exchange with external air by the blowing fan 121.

Accordingly, the first heat exchanger 110 operates as an evaporator.

The second refrigerant changed in a phase, a low-temperature and a low-pressure, in the first heat exchanger 110 passes through the muffler 180 to reduce noise and pulsation, and then flow to the compressor 130.

Figure 2:
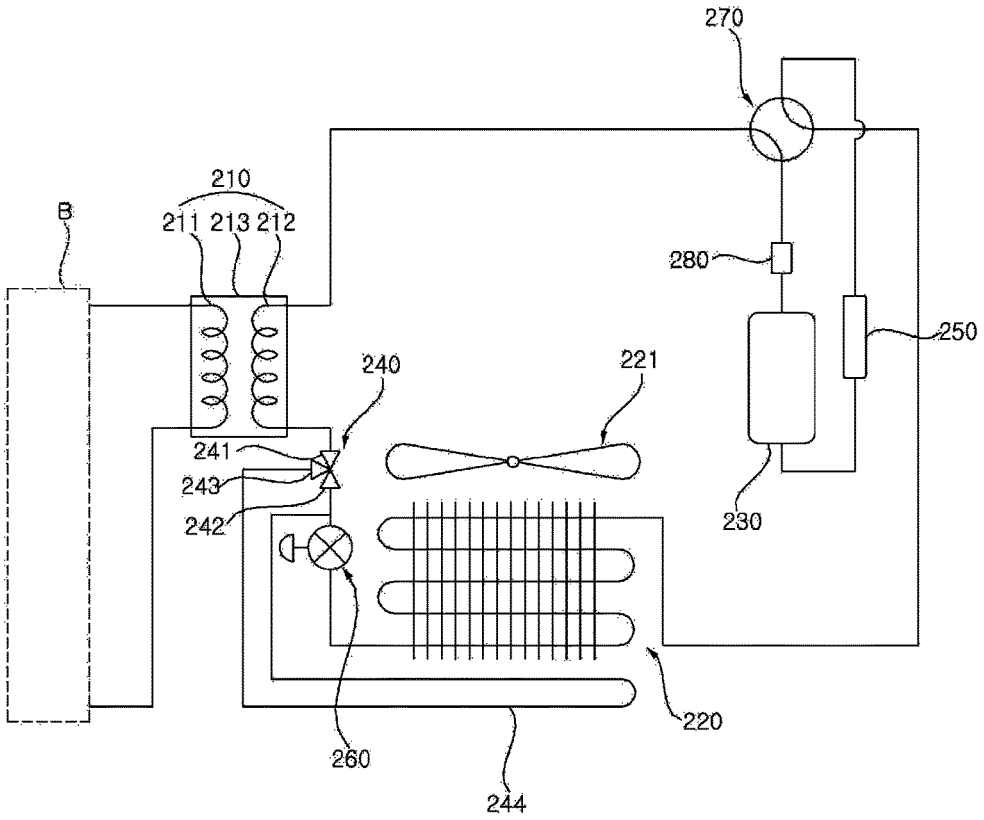
FIG. 2 schematically shows the heat pump according to other embodiment of the present disclosure.

FIG. 2 schematically shows the heat pump according to other embodiment of the present disclosure.

Referring to FIG. 2, in the heat pump according to other embodiment of the present disclosure, as compared with the heat pump of FIG. 1, the position of the three-way valve is different and the other components are the same, so the description of the repeated components is omitted.

The bypass pipe 244 may be branched from the first pipe 212. The second refrigerant flow inside the bypass pipe 244.

The three-way valve 240 shown in FIG. 2 may include a first flow path 241, a second flow path 242, and a third flow path 243. The first flow path 241 may be connected to the first heat exchanger 210. The second flow path 242 may be connected to the second heat exchanger 220. The third flow path 243 may be disposed to join to the first flow path 241 via the bypass pipe 244 exchanging heat with the second heat exchanger 220 and emitted in the direction excluding the first flow path 241 and the second flow path 242.

When the heat pump of FIG. 2 operates in the heating mode, like the case of FIG. 1, the refrigerant emitted from the compressor 230 flow to the first heat exchanger 210 in a state of high temperature and high pressure by the control of the four-way valve 270.

Thereafter, the second refrigerant in a high-temperature and high-pressure state passing through the first heat exchanger 210 is condensed and liquefied during heat exchange with the first refrigerant.

Thereafter, the second refrigerant passes through the expansion valve 260 the second heat exchanger 220 in the state of a two-phase refrigerant with the high temperature and low pressure.

As a result, the second heat exchanger 220 functions as an evaporator, and the surface temperature of the second heat exchanger 220 becomes a low temperature state.

Here, since the surface temperature of the second heat exchanger 220 is lower than the external temperature, the condensate is formed on the surface.

Also, when the external temperature is lower than or equal to the freezing temperature, the condensate is frozen on the surface of the second heat exchanger 120. As this state lasts for a long time, the heat exchange performance of the second heat exchanger 120 with the external air declines due to the freezing of the condensate, and finally, ice frozen on the surface must be removed by performing a defrost operation.

For this, the second refrigerant before flowing into the expansion valve 260 installed between the first heat exchanger 210 and the second heat exchanger 220, by the control of the three-way valve 240, bypass the second heat exchanger 220 through the bypass pipe 244 without passing through the expansion valve 260.

In other words, since the temperature of the second refrigerant passing through the first heat exchanger 210 in a high-pressure state at room temperature or low temperature is higher than the temperature of the second refrigerant of the second heat exchanger 220 acting as an evaporator, ice generated on the surface of the second heat exchanger 220 may be melted and removed.

The bypass pipe 244 may be disposed as close as possible to exchange heat with the second heat exchanger 220, and its position may be variously applied depending on the design position.

Meanwhile, when the heat pump according to other embodiment of the present disclosure operates in the cooling mode, the high-temperature and high-pressure refrigerant emitted from the compressor 230 flow to the second heat exchanger 220 by the control of the four-way valve 270.

Thereafter, the second refrigerant in a high-temperature and high-pressure state passing through the second heat exchanger 220 is condensed and liquefied in the process of being heat-exchanged with external air by the blowing fan 221.

Thereafter, the second refrigerant with the high-temperature, low-pressure passing through the expansion valve 260 passes through the first heat exchanger 210 in the state of a two-phase refrigerant.

Due to this, the first heat exchanger 210 functions as an evaporator.

Like the case of FIG. 1, the second refrigerant phase-changed to the low temperature and low pressure inside the first heat exchanger 210 passes through the muffler 280 to reduce noise and pulsation, and then flow to the compressor 230.

Figure 3:
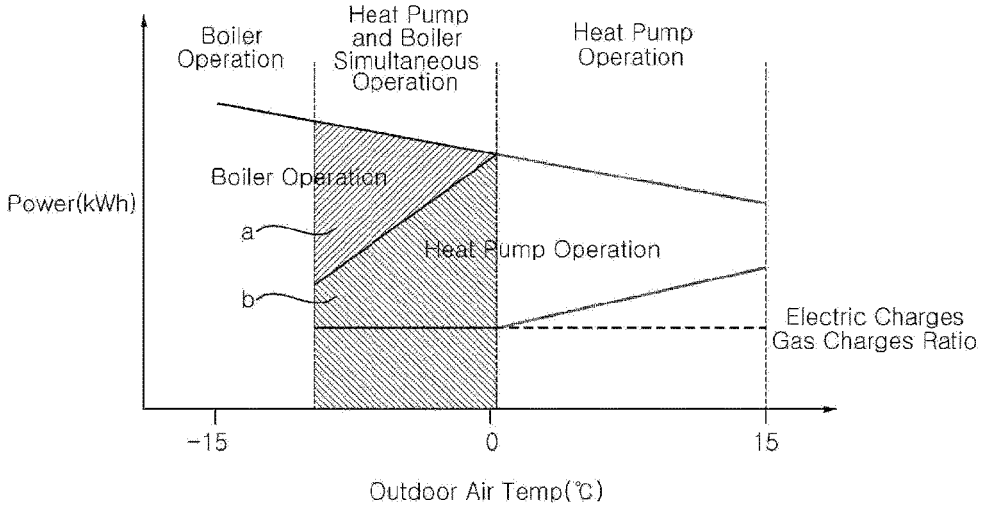
FIG. 3 is a temperature-performance graph in the interlocking operation of boiler-heat pump.

FIG. 3 is a temperature-performance graph in the interlocking operation of boiler-heat pump.

Referring to FIG. 3, only the boiler operates in a region (a region with a temperature lower than the temperature in the a+b region) below a certain temperature. When the outdoor temperature is in the a+b region, efficiency may be increased by operating the boiler and the heat pump at the same time. In this case, if the temperature supplied to the heat pump is low, the condensation temperature of the condenser may be lowered, and accordingly, the degree of subcooling may be secured to improve efficiency.

Preferred embodiments of the present disclosure have been illustrated and described above, but the present disclosure is not limited to the specific embodiments described above. The present disclosure can be implemented in various modifications by those who skilled in the art to which the present disclosure belongs without getting out of the point of the present disclosure in the claims. These modified implementations should not be individually understood from the technical idea or perspective of the present disclosure.

The invention claimed is:

1. A heat pump, comprising:

a first pipe in which a first refrigerant flows;

a second pipe disposed at a side of the first pipe and in which a second refrigerant flows;

a first heat exchanger connected with the first pipe and the second pipe and in which the first refrigerant exchanges heat with the second refrigerant;

a boiler connected with the first pipe and in which the first refrigerant flows;

a compressor connected with the second pipe and that compresses the second refrigerant;

a second heat exchanger connected with the second pipe and in which the second refrigerant exchanges heat with an outdoor air;

a bypass pipe branched from the second pipe and spaced apart from a first side of the second heat exchanger to perform exchange heat with the second heat exchanger;

a blowing fan disposed on a second side of the second heat exchanger, opposite to the first side, to form an air flow through the second heat exchanger; and a three-way valve that directs the second refrigerant to pass through the bypass pipe, wherein a first flow path of the three-way valve is connected with the second pipe, a second flow path of the three-way valve is connected with the second heat exchanger, and a third flow path of the three-way valve joins to the second flow path via the bypass pipe, wherein the heat pump operates in a heating mode, in which the second refrigerant discharged from the compressor flows to the first heat exchanger, and in a cooling mode, in which the second refrigerant discharged from the compressor flows to the second heat exchanger, and wherein in the heating mode, the second refrigerant discharged from the first heat exchanger is sent to the bypass pipe.

2. The heat pump according to claim 1, further comprising:

an accumulator disposed between the compressor and the second heat exchanger.

3. The heat pump according to claim 2, further comprising:

an expansion valve disposed between the second pipe and the second heat exchanger.

4. The heat pump according to claim 3, further comprising:

a four-way valve disposed between the compressor, the first heat exchanger, the accumulator, and the second heat exchanger and configured to change a flow direction of the second refrigerant between the compressor, the first heat exchanger, the accumulator, and the second heat exchanger.

5. The heat pump according to claim 3, wherein the first heat exchanger comprises a plate heat exchanger.

6. The heat pump according to claim 5, wherein the first refrigerant comprises water.

7. The heat pump according to claim 5, wherein the second refrigerant comprises either R32 or R290, or a mixture thereof.

8. The heat pump according to claim 5, further comprising:

a muffler disposed between the four-way valve and the compressor.

* * * * *